United States Patent [19]

Anacker

[11] 3,972,559

[45] Aug. 3, 1976

[54] DUAL PURPOSE CHAIR

[76] Inventor: Charles D. Anacker, 502 Frenchman St., New Orleans, La. 70116

[22] Filed: Nov. 27, 1974

[21] Appl. No.: 527,813

[52] U.S. Cl. ..... 297/1; 297/441; 297/457

[51] Int. Cl.[2] ..... A47C 13/00

[58] Field of Search ..... 297/1, 2, 3, 441, 94, 297/92, 457; D6/65, 66

[56] References Cited

UNITED STATES PATENTS

| | | | |
|---|---|---|---|
| 191,733 | 6/1877 | True | 297/1 |
| 2,433,969 | 1/1948 | Wood | 297/441 X |
| 2,611,418 | 9/1952 | Antelman | 297/1 |
| 3,121,587 | 2/1964 | Bavaro | 297/1 |
| 3,650,563 | 3/1972 | Hansson | 297/441 |

FOREIGN PATENTS OR APPLICATIONS

| | | | |
|---|---|---|---|
| 765,094 | 1/1957 | United Kingdom | 297/441 |

*Primary Examiner*—Roy D. Frazier
*Assistant Examiner*—William E. Lyddane
*Attorney, Agent, or Firm*—William W. Haefliger

[57] ABSTRACT

A dual purpose chair comprises a. a frame assembly having two positions, b. a sling attached to the frame assembly at two locations, the sling including first and second alternate seating sections and a third and flexible section intermediate the two seating sections, c. the third section defining a backrest slidably supported by the frame assembly.

9 Claims, 6 Drawing Figures

DUAL PURPOSE CHAIR

BACKGROUND OF THE INVENTION

This invention relates generally to furniture, and more particularly concerns a dual-purpose chair.

There is a continuing need for chairs characterized by low-cost, lightweight, simple construction. There is also a need for chairs which have different seating elevations and also different backrest recline angles. Insofar as I am aware, there is no previous chair combining most or all of these features, in the unusually advantageous manner as is now afforded by the invention.

SUMMARY OF THE INVENTION

It is a major object of the invention to provide a chair embodying advantages and features mentioned above, as well as others as will appear. Basically, the dual purpose chair comprises:

a. a frame assembly having two positions, b. a sling attached to the frame assembly at two locations, the sling including first and second alternate seating sections and a third and flexible section intermediate the two seating sections, c. the third section defining a backrest slidably supported by the frame assembly.

Further, the sling may have releasable attachment to the frame at two locations; the sling ends may form loops to removably receive dowels held in position by bars at such locations; the chair forms seats at different elevations in the two different frame positions; and the backrests formed by the sling, in such two different frame positions, are at different angles of inclination, as will appear. As a result, by merely shifting the chair bodily between its two positions, the chair selectively acquires two different utilities.

These and other objects and advantages of the invention, as well as the details of an illustrative embodiment, will be more fully understood from the following description and drawings, in which:

DRAWING DESCRIPTION

DETAILED DESCRIPTION

Figure 1:
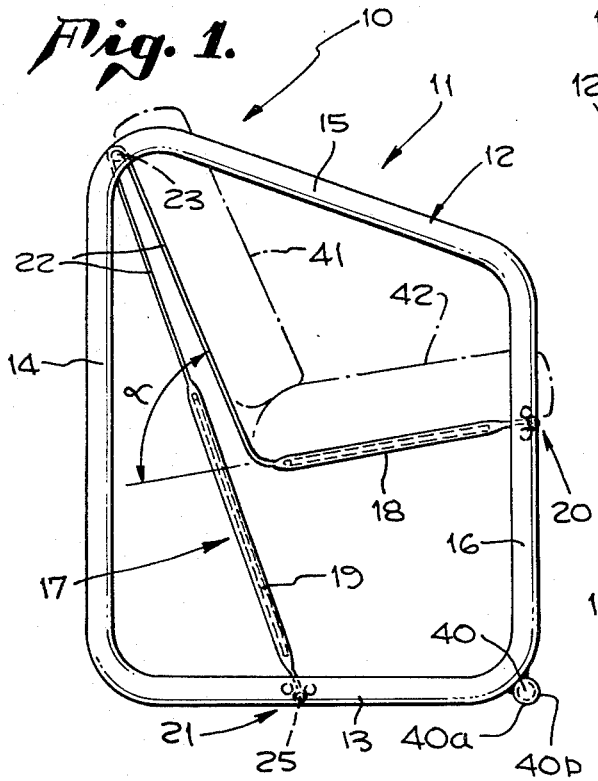
FIG. 1 is a side elevation of a chair embodying the invention.
Figure 2:
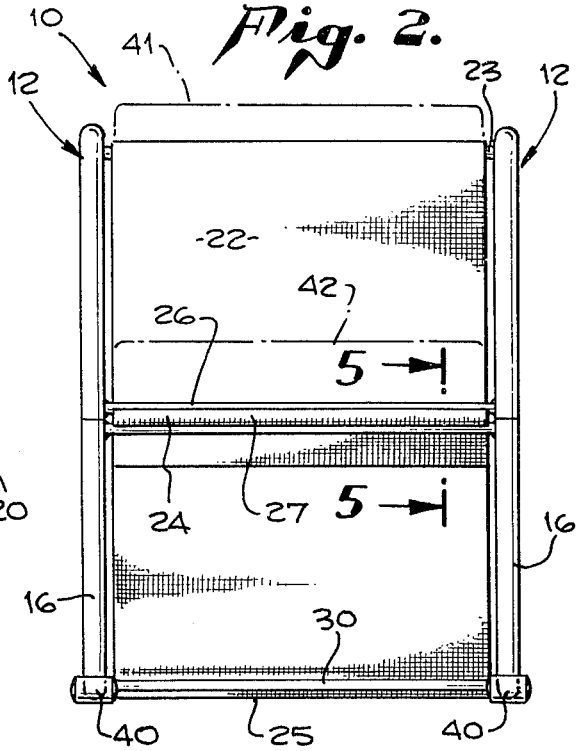
FIG. 2 is a front elevation of the FIG. 1 chair.
Figure 3:
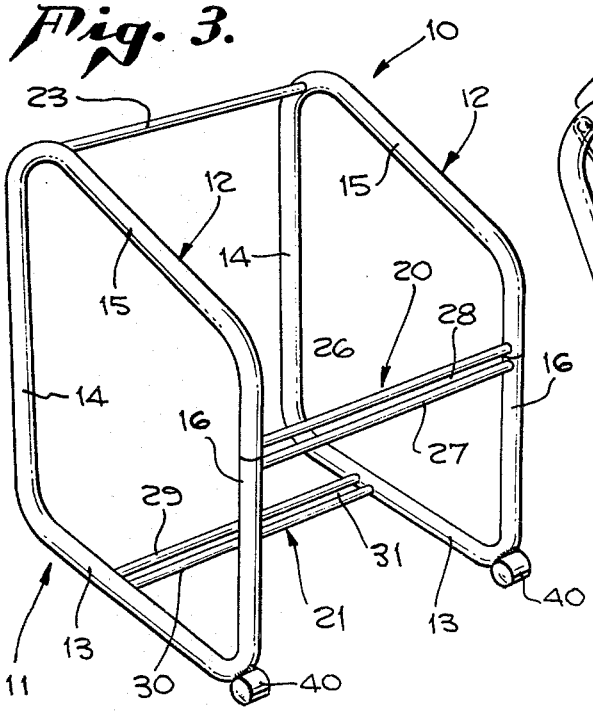
FIG. 3 is a perspective view of the chair.
Figure 4:
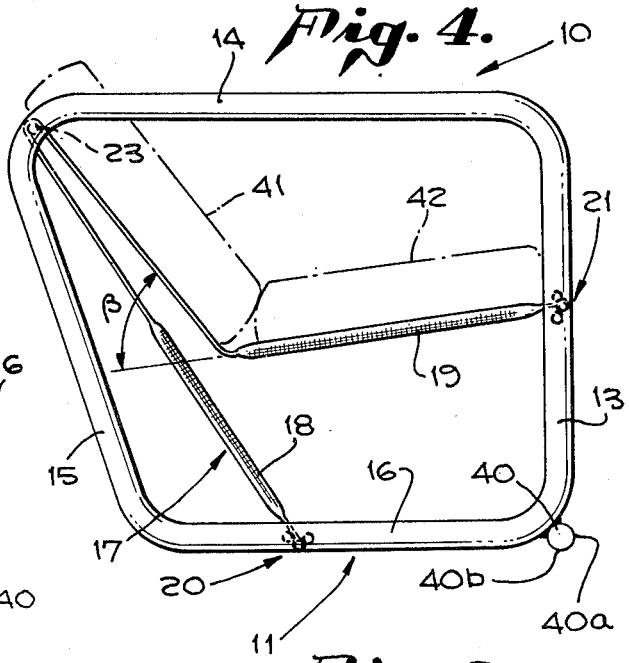
FIG. 4 is a side elevation of the chair in a second configuration.

The chair 10 includes a frame assembly 11 which has two principle positions, as for example are seen in FIGS. 1 and 4. For the purpose, the frame may include two like endless tubular side frames 12 each of which has straight tubular stretches 13–16 and curved corner elements. In one frame assembly position as seen in FIG. 1 the parallel stretches 13 extend horizontally and lowermost, whereas in the second position, as seen in FIG. 4, the parallel stretches 16 extend horizontally and lowermost. Stretches 15 extend at an acute angle relative to stretches 14 and at an obtuse angle relative to stretches 16.

In accordance with an important aspect of the invention, a sling is attached to the frame assembly at two locations, the sling including first and second alternate seating sections and a third and flexible section intermediate the two seating sections. In the example, sling 17, which may consist of canvas or other flexible material, has alternate seating sections 18 and 19, the former releasably attached to the frame at location 20, and the latter releasably attached to the frame at location 21.

A third and flexible section 22 of the sling, intermediate sections 18 and 19, defines a backrest and is slidably supported by the frame assembly. In this regard, section 22 may be looped over the cross bar or rod 23 which interconnects the side frames at acutely angled corners.

The opposite ends of the sling may with unusual advantage, define loops 24 and 25, and the frame assembly at each location 20 and 21 may define a slot to receive one of the loops. For example, two parallel and spaced cross bars or rods 26 and 27 interconnecting frame stretches 16 and from a slot 28 to receive loop 24, and two parallel and spaced cross-bars or rods 29 and 30 interconnecting frame stretches 13 and define a slot 31 to receive loop 25. Means such as elongated wooden dowels 32 are removably receivable endwise in the open ended loops passed through the slots to retain the loops to the frame. In this regard, the dowel diameters are typically greater than the widths of the slots 28 and 31. Upon removal of the dowels, the sling is detached from the frame assembly.

Note that the seating section 18 in FIG. 1 is at a substantially higher elevation in seating position than said seating section 19 in seating position in FIG. 4. Further, the third section backrest extent adjacent one seating section (i.e. section 18 for example in FIG. 1) extends at a first angle $\alpha$ relative to the plane of section 18, in FIG. 1, and the third section backrest extent adjacent the other seating section (i.e. section 19 for example in FIG. 4) extends at a second angle $\beta$ relative to the plane of section 19 in FIG. 4. Angle $\alpha$ is greater than angle $\beta$, i.e. the backrest extent in FIG. 1 is more nearly upright than the backrest extent in FIG. 4, the latter being in a more reclining position. To adjust between these two different conditions, it is only necessary to quickly rotate the chair so that it rests either on frame stretches 13 or stretches 16, and to depress the sling to form the seat, 18 or 19, as the case may be. During such adjustment, the sling third section adjustably slides over bar 23. Caps or protuberances 40 attached to corners 20 aid chair stability, as their surfaces at **40*a* are tangent to the lower edges of stretches 13 in FIG. 1, and their surfaces 40*b* are tangent to the lower edges of stretches 16 in FIG. 4**.

Pillows or cushions 41 and 42 may be laid against the seating and backrest sections of the sling, as shown.

Figure 5:
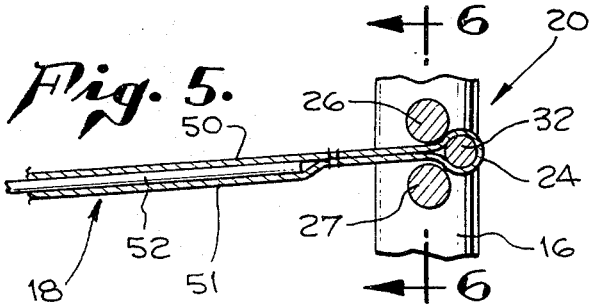
FIG. 5 is an enlarged fragmentary section taken in elevation on lines 5—5 of FIG. 2.
Figure 6:
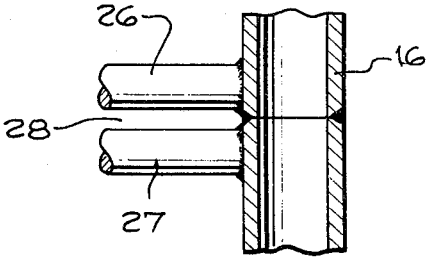
FIG. 6 is a section taken in elevation on lines 6—6 of FIG. 5.

If desired, the sling may be appropriately reinforced, as at the seating sections. Thus, as appears in FIGS. 1, 4 and 5, the seating sections may be formed by canvas pockets (i.e. upper and lower sheets at 50 and 51 in FIG. 5, for example). Metallic structure such as small diameter lightweight tubing 52 extends at the edges or peripheries of the pockets.

I claim:

1. In a dual purpose chair, the combination comprising a. a frame assembly having two positions, b. a sling attached to the frame assembly at first and second locations, the sling including first and second alternate seating sections and a third and flexible section intermediate the two seating sections, c. the third section defining a backrest slidably supported by the frame assembly, at a third location, d. the first and second sections having ends which respectively have releasably anchored attachments with the frame assembly at said first and second locations, said attachments blocking endwise slippage of the first and second sections relative to said attachments when the chair is shifted between said two positions and the third section slides relative to the supporting frame assembly said third location remaining higher than said two locations in each of said chair positions.

2. The chair of claim 1 wherein the ends of the sling define loops, and the frame assembly at each of said first and second locations defines a slot to receive one of the loops, and means removably receivable in the loops passed through the slots to remain the loops to the frame at said locations.

3. The chair of claim 2 wherein said slot is defined by two spaced parallel bars at each of said first and second locations, and said means comprises dowels removably receivable endwise in the loops.

4. The chair of claim 1 wherein said seat sections are defined by fabric, and including seat defining rigid reinforcement means carried by said two seating sections.

5. The chair of claim 4 wherein said fabric defines a pocket at each of the first and second sections, the reinforcement comprising metallic structure in the pocket at the periphery thereof.

6. The chair of claim 4 wherein said third section is also defined by fabric integral with the fabric of the first and second sections.

7. The chair of claim 1 wherein the seat presenting seating sections are at two different elevations in said two chair positions.

8. The chair of claim 5 wherein said third sections adjacent one of said seating section extends at a first upright angle relative to the plane of said one section when said one seating section is in seating position, and said third section backrest extent adjacent the other of the seating sections extends at a second upright angle relative to the plane of the other section when said other seating section is in seating position.

9. The chair of claim 1 wherein the frame assembly is defined by two like endless tubular side frames each of which has four stretches and four corners defining a trapezoid, said two attachments connected with two successive stretches, respectively, said two successive stretches being alternately lowermost in said two chair positions, respectively.

* * * * *